US011523647B2

(12) United States Patent
Yanagita

(10) Patent No.: US 11,523,647 B2
(45) **Date of Patent: *Dec. 13, 2022**

(54) GARMENT

(71) Applicant: Asahi Kasei Kabushiki Kaisha, Tokyo (JP)

(72) Inventor: Naoki Yanagita, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 549 days.

This patent is subject to a terminal disclaimer.

(21) Appl. No.: 16/494,420

(22) PCT Filed: Mar. 20, 2018

(86) PCT No.: PCT/JP2018/011136

§ 371 (c)(1),
(2) Date: Sep. 16, 2019

(87) PCT Pub. No.: WO2018/180801

PCT Pub. Date: Oct. 4, 2018

(65) Prior Publication Data

US 2021/0115601 A1 Apr. 22, 2021

(30) Foreign Application Priority Data

Mar. 27, 2017 (JP) ..... JP2017-061014

(51) Int. Cl.
*A41D 31/12* (2019.01)
*A41D 31/18* (2019.01)
(Continued)

(52) U.S. Cl.
CPC ..... *A41D 31/125* (2019.02); *A41B 1/08* (2013.01); *A41B 17/00* (2013.01); *A41D 31/185* (2019.02);
(Continued)

(58) Field of Classification Search
CPC ... D04B 1/16; D04B 1/18; D04B 1/24; D10B 2401/02; D10B 2401/021; D10B 2401/061
(Continued)

(56) References Cited

U.S. PATENT DOCUMENTS 10,584,432 B2 * 3/2020 Akita ..... D04B 1/18
2004/0237599 A1 * 12/2004 Kondou ..... D04B 15/48 66/202
(Continued)

FOREIGN PATENT DOCUMENTS

CN 104372507 A 2/2015
CN 104372507 A * 2/2015
(Continued)

OTHER PUBLICATIONS

Supplementary European Search Report issued in corresponding European Patent Application No. 18774579.9 dated Apr. 3, 2020.
(Continued)

*Primary Examiner* — Danny Worrell
*Assistant Examiner* — Aiying Zhao
(74) *Attorney, Agent, or Firm* — Morgan, Lewis & Bockius LLP

(57) ABSTRACT

Provided is a knit fabric which does not cause feelings of clamminess, feels very cool to the touch and is comfortable, and limits feelings of stickiness and post-sweat chill through rapid drying of sweat, and at the same time is capable of further improving texture. The garment comprises a multi-layer-structure circular-knit fabric made of a single circular knit with a layered structure of at least two layers, and the surface that contacts the skin is the needle-loop side of the circular-knit fabric. The circular-knit fabric has portions in which long cellulose fibers and hydrophobic fibers are knit together to form the same knit loops. The garment contains
(Continued)

Needle-loop side surface

Sinker-loop side surface 10-50 weight % of the long cellulose fibers. The exposure rate of the long cellulose fibers in the region from the surface of the side that contacts the skin to 0.13 mm into the interior of the circular-knit fabric is at least 30%.

10 Claims, 2 Drawing Sheets

(51) Int. Cl.

| | |
|---|---|
| ***A41B 1/08*** | (2006.01) |
| ***A41B 17/00*** | (2006.01) |
| ***D04B 1/16*** | (2006.01) |
| ***D04B 1/24*** | (2006.01) |
| ***D04B 1/18*** | (2006.01) |

(52) U.S. Cl.
CPC ..... *D04B 1/16* (2013.01); *D04B 1/18* (2013.01); *D04B 1/24* (2013.01); *D04B 1/246* (2013.01); *D06M 2200/12* (2013.01); *D10B 2201/00* (2013.01); *D10B 2201/20* (2013.01); *D10B 2331/02* (2013.01); *D10B 2331/04* (2013.01); *D10B 2331/10* (2013.01); *D10B 2401/021* (2013.01); *D10B 2401/022* (2013.01); *D10B 2401/061* (2013.01); *D10B 2403/0114* (2013.01); *D10B 2501/02* (2013.01)

(58) Field of Classification Search
USPC ..... 66/171
See application file for complete search history.

(56) References Cited

U.S. PATENT DOCUMENTS

| | | | | |
|---|---|---|---|---|
| 2013/0209743 | A1* | 8/2013 | Deguchi | D04B 1/24 428/156 |
| 2018/0116318 | A1* | 5/2018 | Xia | A41D 31/185 |
| 2018/0266024 | A1 | 9/2018 | Akita | |

FOREIGN PATENT DOCUMENTS

| | | | | |
|---|---|---|---|---|
| JP | H03-027148 | A | | 2/1991 |
| JP | H09-273045 | A | | 10/1997 |
| JP | H10-025643 | A | | 1/1998 |
| JP | H10-219551 | A | | 8/1998 |
| JP | 2001-020159 | A | | 1/2001 |
| JP | 2003-183952 | A | | 7/2003 |
| JP | 2011-140733 | A | | 7/2011 |
| JP | 2011140733 | A | * | 7/2011 |
| JP | 2013-213300 | A | | 10/2013 |
| JP | 2014-139355 | A | | 7/2014 |
| JP | 2014139355 | A | * | 7/2014 |
| JP | 5788895 | B2 | | 10/2015 |
| TW | 201704577 | A | | 2/2017 |
| WO | 2012/049870 | A1 | | 4/2012 |
| WO | 2017/057391 | A1 | | 4/2017 |

OTHER PUBLICATIONS

International Search Report issued in corresponding International Patent Application No. PCT/JP2018/011136 dated Jun. 26, 2018.
International Preliminary Report on Patentability and Written Opinion issued in corresponding International Patent Application No. PCT/JP2018/011136 dated Oct. 10, 2019.

* cited by examiner

GARMENT

FIELD

The present invention relates to a garment comprising a multilayer-structure circular knit fabric which is excellent in water-absorption quick-drying while being excellent in hygroscopicity and tactile coolness, and which has suitable texture, refreshing properties, and sweat processing performance.

BACKGROUND

Cellulose-based materials such as cotton and cupra are excellent in hygroscopicity and water absorption, and when used in clothing, are very comfortable in the absence of sweat or when sweating in only small amounts. However, when the amount of sweat increases, such as during the summer or during exercise, the sweat absorbed by the cellulose-based material is held in the fibers, the diffusion of water does not occur, quick-drying performance is poor, and a feeling of stickiness persists, whereby a feeling of coldness is likely to occur.

Patent Literature 1 below proposes, as a method for combining the comfort and quick-drying properties of cellulose-based materials, a knit fabric having a two or more layer structure, in which polyester processed yarns, which are hydrophobic fibers, are arranged in the skin surface layer, and a cellulose multifilament is arranged in the intermediate layer or the surface layer, to produce a knit fabric structure in which the cellulose multifilament does not contact the skin, whereby a fabric with improved quick-drying properties and wetness-returning resistance, as well as hygroscopicity, is obtained. However, in such a fabric, since the cellulose fibers do not contact the skin at all, moisture and sweat released from the skin are unlikely to be quickly absorbed, whereby there is a problem in that high tactile coolness is unlikely to be obtained.

Patent Literature 2 below proposes a knit fabric which is unlikely to feel sticky or cold, and which has a reduced sensation of stuffiness, wherein the knit fabric is obtained through the use of a knit fabric structure in which the exposure ratio of long cellulose fibers (cellulose filaments) on the surface of a convex part in contact with the skin is up to 15%, and the amount of cellulose fibers contacting the skin surface is minimized. However, in such a knit fabric, since the maximum exposure rate of the long cellulose fibers is 15%, the obtained tactile coolness is insufficient.

Patent Literature 3 below proposes a woven fabric wherein a structure in which a rayon filament having a high single-fiber fineness is arranged in the skin surface layer, and cotton is arranged in the surface layer is used in order to obtain tactile coolness. However, in such a woven fabric, since a rayon filament having a high single-fiber fineness is used, capillary action is insufficient. Since all of the materials constituting the knit fabric are cellulose-based materials, absorbed water is held therein, and since the water does not diffuse, the quick-drying properties thereof are inferior, whereby there is a problem in that sticky and clammy sensations are experienced. Further, since the rayon filament, which has a high single-fiber fineness, is used in the skin surface layer, the texture thereof is poor.

Patent Literature 4 below proposes an undergarment comprising a knit fabric in which the needle-loop side is on the skin-contacting surface in order to obtain suitable texture. However, since such knit fabric is made using a bare plain stitch consisting of elastic yarns and inelastic yarns, when hydrophobic fibers or composite yarns comprising hydrophobic fibers are used, there are problems in that the low cellulose fiber content and small skin-contacting surface area make it difficult for moisture and sweat from the skin surface to be quickly absorbed, whereby high tactile coolness is unlikely to be obtained. Furthermore, when cellulose fibers are used as the inelastic yarns, though excellent moisture absorption and release properties and tactile coolness are obtained, since cellulose-based materials retain absorbed sweat in the fibers, and the moisture does not diffuse, and the quick-drying properties thereof are inferior, whereby there is a problem in that a sticky sensation persists, and post-sweat chill is likely to occur.

CITATION LIST

Patent Literature

[PTL 1] Japanese Unexamined Patent Publication (Kokai) No. 10-25643
[PTL 2] WO 2012/049870
[PTL 3] Japanese Unexamined Patent Publication (Kokai) No. 3-27148
[PTL 4] Japanese Unexamined Patent Publication (Kokai) No. 2013-213300

SUMMARY

Technical Problem

In light of the problems of the prior art described above, the object of the present invention is to provide a garment which does not feel stuffy, which is cool and comfortable to the touch, from which sweat can dry quickly, and in which sticky and clammy sensations are limited while simultaneously providing further improved texture.

Solution to Problem

As a result of rigorous investigation in order to achieve the object described above, the present inventors have discovered that excellent texture, tactile coolness, and quick-drying properties can be achieved by constructing identical knit loops by knitting together long cellulose fibers and hydrophobic fibers, arranging the long cellulose fibers on the knit fabric surface layer (the needle-loop side), arranging the hydrophobic fibers in the knit fabric rear surface layer (the sinker-loop side), and making the skin-contacting surface of the garment the knit fabric surface (the needle-loop side), which is different from conventional garments, and as a result, have completed the present invention.

Note that as shown in FIG. 1, in circular knitting, "needle-loop side" refers to the surface on which V-shaped continuous stitches are regularly arranged in the warp direction, and "sinker-loop side" refers to the surface on which semicircular stitches are aligned in the weft direction.

Specifically, the present invention is as described below.

[1] A garment comprising a multilayer-structure circular knit fabric composed of a single circular knit having a layer structure of at least two layers, and having a skin-contacting surface which is a needle-loop side of the circular-knit fabric, wherein the circular-knit fabric has a portion in which long cellulose fibers and hydrophobic fibers are knitted together to form identical knit loops, the circular-knit fabric contains 10 to 50 wt % of the long cellulose fibers, an exposure rate of the long cellulose fibers in a region from the skin-contacting surface within 0.13 mm toward the interior of the circular-knit fabric is at least 30%, a tactile coolness of the circular-knit fabric is 130 to 200 W/m2·° C., and the time at which a moisture content of the circular-knit fabric becomes 10% after 0.3 cc of water is dripped thereon is not greater than 50 minutes.

[2] The garment according to [1], wherein a single-fiber fineness of the long cellulose fibers is 0.1 to 7.0 dtex.

[3] The garment according to [1] or [2], wherein the average coefficient of friction of the skin-contacting surface of the circular-knit fabric is not greater than 0.45, and the average deviation of the coefficient of friction is not greater than 0.0090.

[4] The garment according to any one of [1] to [3], wherein the multilayer-structure circular knit fabric has a plain knit structure.

[5] The garment according to any one of [1] to [4], wherein a fiber length ratio of the long cellulose fibers to the hydrophobic fibers is 1.01 to 1.20.

[6] The garment according to any one of [1] to [5], wherein a single-fiber fineness ratio of the long cellulose fibers to the hydrophobic fibers is 0.3 to 1.0.

[7] The garment according to any one of [1] to [6], wherein a total fineness ratio of the long cellulose fibers to the hydrophobic fibers is 1.0 to 3.0.

[8] The garment according to any one of [1] to [7], wherein the multilayer-structure circular knit fabric has undergone a water absorption treatment.

[9] The garment according to any one of [1] to [8], wherein a difference in height irregularities of the skin-contacting surface of the multilayer-structure circular knit fabric is not greater than 0.13 mm.

[10] The garment according to any one of [1] to [9], wherein the multilayer-structure circular knit fabric further includes elastic fibers, and the elastic fibers are arranged in an intermediate layer.

[11] The garment according to any one of [1] to [10], wherein the multilayer-structure circular knit fabric is composed of a structure in which identical loops of the long cellulose fibers and the hydrophobic fibers are formed, and a structure in which only loops of the hydrophobic fibers are formed.

Advantageous Effects of Invention

The garment according to the present invention is excellent in tactile coolness and hygroscopicity, has improved moisture diffusion, exhibits quick-drying properties without a feeling of stuffiness, has an excellent refreshing sensation, and can limit the feeling of stickiness and post-sweat chill by facilitating the drying of sweat quickly. Since the garment comprises a multilayer-structure circular knit fabric having a suitable texture, the garment is suitable as an undergarment, sportswear, or casualwear.

DESCRIPTION OF EMBODIMENTS

Figure 1:
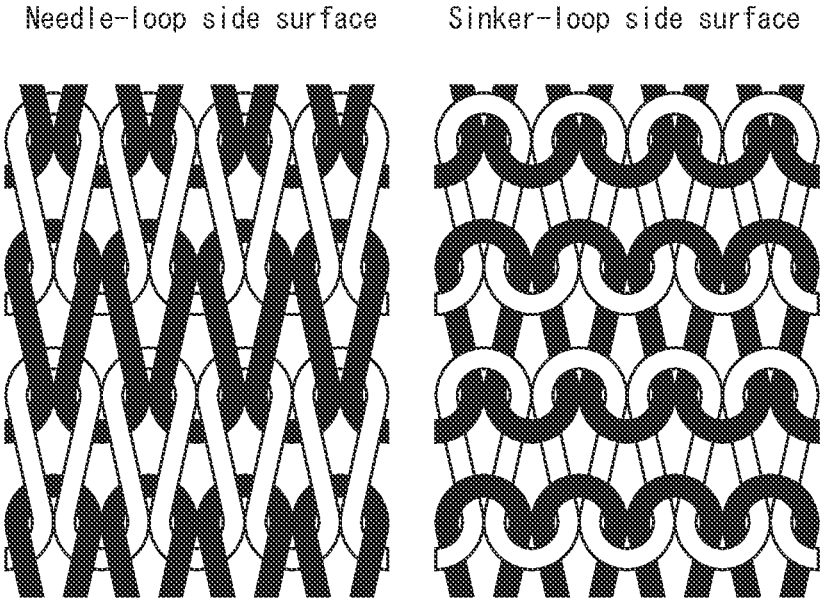
FIG. 1 is a perspective view of the needle-loop side and sinker-loop side of a single circular-knit fabric.

The embodiments of the present invention will be described in detail below.

The garment of the present embodiment comprises a single circular knit having a layer structure including two or more layers, and is characterized in that the needle-loop side is used on the skin surface side. Conventionally, when a consumer checks the texture or feel of a product in a store, they check the texture of the "front side". If the texture of the outer surface of the garment is excellent, the value of the product is considered to be high, and thus, this texture is considered important. Therefore, it is natural to arrange the needle-loop side, which has a texture which is superior to the sinker-loop side, on the outer surface of the garment. Though attempts have been made to improve the quality of the sinker-loop side arranged on the skin surface of the garment by changing the gauge or multiplexing the yarn, in the needle-loop side surface and sinker-loop side surface of a knit fabric, the texture of the sinker-loop side surface is never superior to the texture of the needle-loop side surface. In the multilayer-structure circular knit fabric used in the garment of the present embodiment, in order to improve comfort when worn, i.e., the skin surface texture, the needle-loop side is arranged on the skin surface, as opposed to conventional cases. As a result, the smoothness of the skin-contacting surface can be improved, whereby an excellent texture is obtained. Furthermore, by arranging the cellulose fibers on the needle-loop side, which has a high smoothness, and increasing the contact area between the cellulose fibers and the skin, the excellent tactile coolness of the cellulose fibers can be best utilized.

The multilayer-structure circular knit fabric constituting the garment of the present embodiment is characterized in that portions are provided in which identical loops of long cellulose fibers and hydrophobic fibers are formed. By forming a layer structure having two or more layers, the surface layer and the back layer of the knit fabric can be completely separated, and individual functions can be assigned to the individual layers. As a conventional method for obtaining a layer structure having two or more layers, a method in which a layer structure having two or more layers is formed by knitting each of the layers while changing the knit structure for each layer using a double circular knitting machine. For example, using the two rows of needle beds of a double circular knitting machine, a plain stitch is formed on the dial side needle bed and a plain stitch including a tuck stitch is formed on the cylinder side needle bed. The fabric knitted on the dial side needle bed is connected to the fabric knitted on the cylinder side needle bed, whereby a knit fabric having a two-layer structure in which the plain stitches are overlapped can be obtained. A three-layer structure can be obtained by separately knitting a plain stitch knit fabric woven with the needle bed on the dial side and a plain stitch knit fabric woven with the needle bed on the cylinder side followed by separately knitting a layer that binds both of the plain stitch knit fabrics (double-sided tack knitting).

Conversely, the layer structure including two or more layers of the present embodiment is not formed of knitting structures, but rather, a layer structure of yarns in which the yarns to be used are arranged on the front surface or back surface of knit fabric according to the knitting conditions, and is obtained from only a single circular knit. "Only a single circular knit" means that the knit fabric is sewn using only a single needle bed, in which one of the fabric surfaces is composed of knit loops and the other fabric surface is composed of sinker loops. A double circular knit differs from a single circular knit in that is it composed primarily of knit loops on both surfaces of the knit fabric. A single type of fiber is conventionally used in double circular knits, which thus differ from the configuration of the present embodiment in which long cellulose fibers and hydrophobic fibers form identical knit loops, and each of the layers is arranged in the front surface layer and back surface layer of the knit fabric, and thus, it is difficult for double circular knits to satisfy the desired tactile coolness and quick-drying properties.

Figure 2:
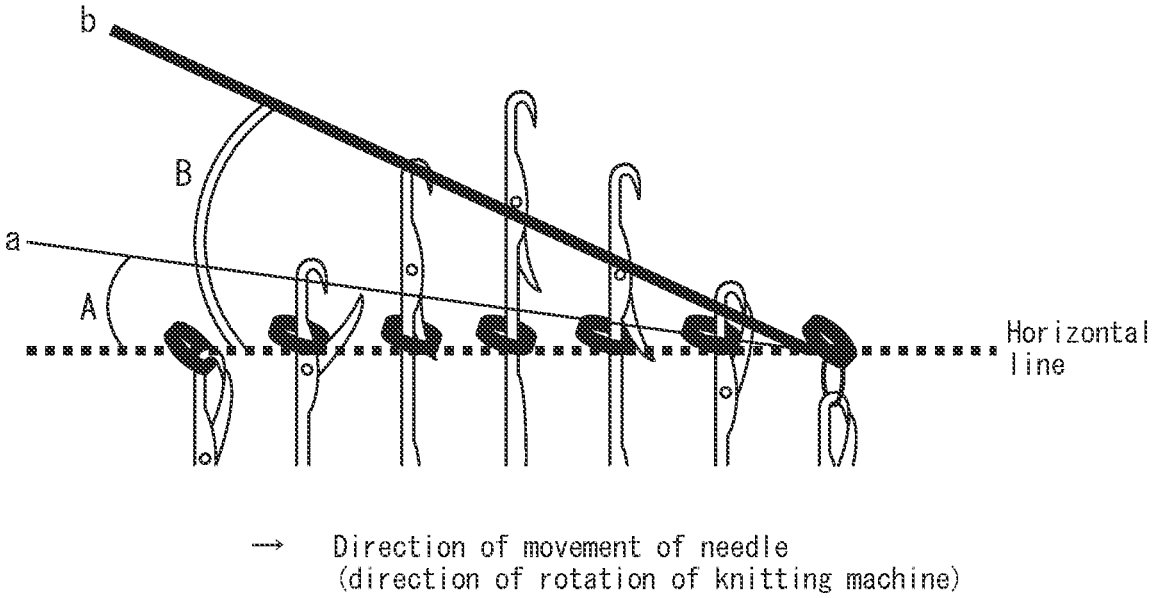
FIG. 2 is an example of the fiber feed angle during plating.

As the method for forming a single circular knit having a layer structure including two or more layers and including portions in which identical loops in which long cellulose fibers and hydrophobic fibers are knitted together, plating using a single circular knitting machine is preferred. In plating, by adjusting the fiber feed angles of the stitching needles while knitting a plurality of fibers together, the fibers can be arbitrarily arranged on the needle-loop side surface layer or the sinker-loop side surface layer of the knit fabric. The tactile coolness can be increased by adjusting the fiber feed angle so that the long cellulose fibers are arranged on the needle-loop side surface layer and the hydrophobic fibers b are arranged on the sinker-loop side surface layer, as shown in FIG. 2. The fiber feed angle refers to the angle of the yarn fed to the knitting needle based on a horizontal line connecting the head positions of the knitting needles before the knitting needles are raised by the raising cam, when the knitting machine is viewed from the side. When the long cellulose fibers a are used in the needle-loop side surface layer and the hydrophobic fibers b are used in the sinker-loop side surface layer, it is preferable that the fiber feed angles be adjusted so that the ratios "the fiber feed angle B of the hydrophobic fibers b>the fiber feed angle A of the long cellulose fibers a" and "(fiber feed angle B of the hydrophobic fibers b)−(fiber feed angle A of the long cellulose fibers a)>10°)" are satisfied. It is preferable that the fiber feed angle be adjusted to within the range of 0 to 90°. The fiber feed angle B of the hydrophobic fibers b is preferably 20 to 80°, more preferably 30 to 70°, further preferably 40 to 60°, and particularly preferably 40 to 50°, and the fiber feed angle of the long cellulose fibers a is preferably 10 to 70°, more preferably 20 to 60°, further preferably 20 to 50°, and particularly preferably 20 to 40°.

Further, as the method of arbitrarily arranging the fibers on the needle-loop side surface layer or the sinker-loop side surface layer of the knit fabric, the yarn feed tension at the time of knitting can be adjusted. In order to ensure that the long cellulose fibers a are arranged in the needle-loop side surface layer and the hydrophobic fibers b are arranged in the sinker-loop side surface layer, the tensile ratio thereof (yarn tension of the long cellulose fibers/yarn tension of the hydrophobic fibers) is preferably 0.25 to 0.67, more preferably 0.28 to 0.5, further preferably 0.33 to 0.5, and particularly preferably 0.33 to 0.4. By setting both the fiber feed angles and the tensile ratio to within the above ranges, a suitable plating state can be obtained, whereby the desired layer structure can be obtained. A suitable plating state can be obtained by setting either of the fiber feed angle or the tension ratio to within the above ranges.

By forming identical loops of long cellulose fibers and hydrophobic fibers, moisture can be transferred to not only the long cellulose fibers but also to the hydrophobic fibers, which are in close contact with the long cellulose fibers, which can increase diffusivity and improve the quick-drying properties. When the long cellulose fibers and the hydrophilic fibers do not form identical knitted loops, sufficient quick-drying properties cannot be obtained and the refreshing properties of the knit fabric become poor. Though it is preferable that the knitted loops, in which the long cellulose fibers and the hydrophobic fibers form identical knitted loops, be continuously formed in the warp direction and the weft direction of the knit fabric, even if the knitted loops are not continuously formed, the effect can be exhibited as long as a portion in which the long cellulose fibers and the hydrophobic fibers form identical knitted loops is included.

Figure 3:
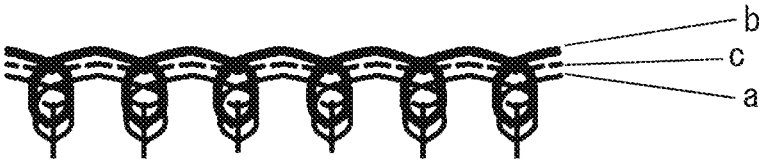
FIG. 3 is an example of the knitting structure of a multilayer circular-knit fabric constituting the garment according to the present embodiment.

The multilayer-structure circular knit fabric of the present embodiment may include elastic fibers, which may be arranged in an intermediate layer. The intermediate layer is not particularly limited as long as it is not the outermost layer. For example, when a three-layer structure is formed by plating three types of yarns using the elastic fibers c, as shown in FIG. 3, since the elastic fibers c are fed to the knitting needles in an elongated state, after knitted, the elongated state is released and the elastic fibers c contract, whereby inevitably the knitted loops of the elastic fibers become smaller than those of the other fibers and are arranged most inwardly, and thus, the elastic fibers c will be in the intermediate layer of the three-layer structure. As a result, the elastic fibers are not exposed on the outer surfaces of the garment, and excellent aesthetics can be obtained since the reflectiveness of the polyurethane fibers, which are difficult to dye, is not discernable.

The long cellulose fibers a used in the multilayer-structure circular knit fabric of the present embodiment may be regenerated cellulose long fibers such as rayon, cupra, or acetate, or natural cellulose long fibers such as cotton, though the long cellulose fibers are not particularly limited. These fibers have less fuzzing and a smoother yarn surface as compared with cotton and cellulose short fibers (cellulose filaments), and thus, the water diffusivity thereof is high. Among these fibers, regenerated cellulose long fibers are preferable, and among these, rayon long fibers or cupra long fibers are more preferable since the moisture content of the fibers is high, leading to a high hygroscopicity. Further, cupra long fibers are particularly preferable since they have a round cross-section, have a smoother single-fiber surface as compared to rayon long fibers, have a very soft texture when used in a knit fabric due to the low fineness thereof, and have a higher diffusivity. The long cellulose fibers may be used in the form of a single-component yarn or in the form of a composite yarn in which other fibers are mixed therewith. From the viewpoint of reducing the unevenness of the skin surface and improving the exposure rate of the long cellulose fibers, it is preferable that the long cellulose fibers be used in the form of a single-component yarn.

Furthermore, it is particularly preferable that titanium oxide be included in the long cellulose fibers, since the UV reduction properties and tactile coolness thereof are improved thereby.

The hydrophobic fibers b used in the multilayer-structure circular knit fabric of the present embodiment may be synthetic fibers such polyester fibers, polyamide fibers, or polypropylene fibers, though the hydrophobic fibers b are not limited as long as they are hydrophobic. However, synthetic fibers as used herein does not encompass elastic fibers.

Furthermore, the form of the short fibers (staples) and long fibers (filaments) is not limited, and the fibers may be constituted by a composite twist yarn, mixed yarn, or false twist mixed yarn. In particular, in order to obtain a spun yarn texture, it is preferable that a polyester spun yarn be used, and in order to improve the quick-drying properties, polyester long fibers or polyamide long fibers are preferably used.

The multilayer-structure circular knit fabric of the present embodiment comprises 10 to 50 wt % of long cellulose fibers, preferably 15 to 45 wt %, more preferably 20 to 40 wt %, and further preferably 25 to 35 wt %. When the content of long cellulose fibers is less than 10 wt %, a sensation of stuffiness is brought about due to insufficient hygroscopicity, which may cause discomfort. Conversely, when the content exceeds 50 wt %, the moisture retention capacity of the knit fabric itself becomes excessive, whereby the quick-drying properties become inferior.

In the multilayer-structure circular knit fabric of the present embodiment, the difference in height irregularity on the skin-contacting surface (needle-loop side surface layer) is preferably 0.13 mm or less, more preferably 0.10 mm or less, further preferably 0.09 mm or less, and even further preferably 0.08 mm or less. By minimizing irregularity, smoothness is enhanced, whereby excellent texture and tactile coolness can be obtained. The difference in height irregularity of the needle-loop side surface can be set to 0.13 mm or less by decreasing the gauge of the knitting structure and machine, and reducing the yarn length of the fibers used in the needle-loop side surface layer. When the yarn length of the fibers used in the needle-loop side surface layer is reduced, the knitting loops of the fibers become small, and are exposed on the knit fabric surface layer, whereby the difference in the irregularity in height of the needle-loop side surface is reduced. Furthermore, by eliminating yarn length difference and fineness difference in the wale direction (the vertical direction of the knit fabric), the difference in height irregularity can become 0.13 mm or less. If the difference in height irregularity exceeds 0.13 mm, the area of contact of the fabric with the skin may be reduced, whereby excellent tactile coolness and texture may not be obtained.

In the multilayer-structure circular knit fabric of the present embodiment, the exposure rate of the long cellulose fibers in a region within 0.13 mm from the needle-loop side surface layer is 30% or more, preferably 50% or more, more preferably 60% or more, further preferably 70% or more, and particularly preferably 80% or more. When the exposure rate of the long cellulose fibers in a region within 0.13 mm from the needle-loop side surface is less than 30%, sufficient tactile coolness may not be obtained. As described above, a long cellulose fiber exposure rate of 30% or more in a region within 0.13 mm from the needle-loop side surface means a structure in which the long cellulose fibers included in the knit fabric are concentrated on the needle-loop side surface layer. Such a configuration increases the tactile coolness of the knit fabric.

In the multi-layer structure circular knit fabric of the present embodiment, the tactile coolness of the needle-loop side surface is 130 to 200 $W/m^2/°$ C., preferably 135 to 190 $W/m^2/°$ C., more preferably 140 to 180 $W/m^2/°$ C., further preferably 145 to 175 $W/m^2/°$ C., and particularly preferably 150 to 170 $W/m^2/°$ C. When the tactile coolness exceeds 200 $W/m^2/°$ C., the cool sensation becomes excessive, which may be excessively cold.

In the multilayer-structure circular knit fabric of the present embodiment, the time at which the moisture content of the fabric becomes 10% after 0.3 cc of water has been dripped thereon is 50 minutes or less, preferably 45 minutes or less, and more preferably 43 minutes or less. When the time at which the moisture content of the fabric becomes 10% after 0.3 cc of water has been dripped thereon exceeds 50 minutes, sweat is held in the knit fabric for a long period of time, whereby a feeling of stickiness and post-sweat chill are brought about, which may be uncomfortable.

In the multilayer-structure circular knit fabric of the present embodiment, the average coefficient of friction of the needle-loop side surface is 0.45 or less, and more preferably 0.40 or less. Furthermore, the average deviation of the coefficient of friction of the needle-loop side surface is 0.0090 or less, and preferably 0.0080 or less. By setting the average coefficient of friction of the needle-loop side surface to 0.45 or less and the average deviation of the coefficient of friction of 0.0090 or less, the friction with the skin is reduced when worn and during operations, whereby operability and texture are further improved.

The multilayer-structure circular knit fabric of the present embodiment is preferably subjected to a water absorption treatment. When a water absorption treatment is applied, water absorption is imparted to the hydrophobic fibers used, whereby diffusivity is increased, and quick-drying properties are improved. In particular, when the hydrophobic fibers which form identical knit loops with the long cellulose fibers are subjected to a water absorption treatment, the water content of the adhered long cellulose fibers can be transferred to the hydrophobic fibers, whereby diffusivity is increased and quick-drying properties are improved. The water absorption treatment agent used is not particularly limited, and any convention water absorption treatment agent can be used.

The fineness of the long cellulose fibers constituting the multilayer-structure circular knit fabric of the present embodiment is not particularly limited, and is preferably 30 to 200 dtex, more preferably 30 to 180 dtex, further preferably 30 to 150 dtex, and particularly preferably 50 to 120 dtex.

The single-fiber fineness of the long cellulose fibers constituting the multilayer-structure circular knit fabric of the present embodiment is preferably 0.1 to 7.0 dtex, more preferably 0.5 to 5.0 dtex, further preferably 0.5 to 4.0 dtex, particularly preferably 1.0 to 3.0 dtex, and further particularly preferably 1.0 to 2.0 dtex. When the single-fiber fineness of the cellulose long fibers is less than 0.1 dtex, when worn, single-fiber breakage may occur due to friction, whereby frictional durability is reduced. Conversely, when the single-fiber fineness exceeds 7.0 dtex, diffusivity when water is absorbed in insufficient, whereby the quick-drying properties are insufficient, and a poor texture may occur.

The fineness of the hydrophobic fibers constituting the multilayer-structure circular knit fabric of the present embodiment is not particularly limited, and a No. 100 to No. 30 spun yarn is preferably used. A No. 90 to No. 30 spun yarn is particularly preferable, and a No. 80 to No. 40 spun yarn is further preferable.

The single-fiber fineness of the hydrophobic fibers constituting the multilayer-structure circular knit fabric of the present embodiment is preferably 0.3 to 3.0 dtex, more preferably 0.5 to 2.5 dtex, further preferably 0.6 to 2.0 dtex, and particularly preferably 0.7 to 1.5 dtex. Note that in the multilayer-circular knit fabric of the present embodiment, the hydrophobic fibers primarily constitute the sinker-loop side surface.

In the multilayer-structure circular knit fabric of the present embodiment, the single-fiber fineness ratio of the long cellulose fibers to the hydrophobic fibers is preferably 0.3 to 1.0, more preferably 0.4 to 0.9, further preferably 0.5 to 0.8, and particularly preferably 0.6 to 0.7. If the single-fiber fineness ratio of the long cellulose fibers to the hydrophobic fibers is less than 0.3, the single-fiber thickness of the long cellulose fibers becomes excessive, whereby texture is reduced, and the single-fiber fineness of the hydrophobic fibers becomes excessively thin, which causes piling and the generation of fuzz, which brings about poor quality. Conversely, if the single-fiber fineness ratio of the long cellulose fibers to the hydrophobic fibers exceeds 1.0, the single-fiber fineness of the long cellulose fibers becomes smaller than the single-fiber fineness of the hydrophobic fibers, whereby the diffusion of water by the hydrophobic fibers is insufficient, and the quick-drying properties may be insufficient.

In the multilayer-structure circular knit fabric of the present embodiment, the (total) fineness ratio of the long cellulose fibers to the hydrophobic fibers is preferably 1.0 to 3.0, more preferably 1.2 to 2.6, further preferably 1.3 to 2.2, and particularly preferably 1.4 to 1.8. When the fineness ratio of the long cellulose fibers to the hydrophobic fibers is less than 1.0, the fineness of the long cellulose fibers becomes greater than the fineness of the hydrophobic fibers, whereby the long cellulose fibers are also present on the sinker-loop side surface (the side opposite the skin-contacting surface), rather than only on the needle-loop side surface (skin-contacting surface), whereby skitteriness and poor quality occur. Conversely, when the fineness ratio of the long cellulose fibers to the hydrophobic fibers exceeds 3.0, it becomes difficult to achieve the long cellulose fiber content ratio, whereby the interval between sinker loops aligned in the warp direction of the knit fabric is widened, resulting in poor texture.

In the multilayer-circular knit fabric of the present embodiment, the fiber length ratio of the long cellulose fibers to the hydrophobic fibers is preferably 1.01 to 1.20, more preferably 1.02 to 1.15, and further preferably 1.02 to 1.10. If the fiber length ratio of the long cellulose fibers to the hydrophobic fibers is less than 1.01, the hydrophobic fibers forming identical knit loops are exposed on the needle-loop side surface (the skin-contacting surface), whereby the contact area of the cellulose long fibers with the skin is reduced, and the coolness is reduced. Conversely, when the fiber length ratio exceeds 1.20, the long cellulose fibers are exposed on the needle-loop side surface, whereby though the coolness is improved, snagging on the sinker-loop side surface and abrasion loss of the cellulose fibers may increase.

It is preferable that a plain knit structure be partially used in the multilayer-structure circular knit fabric of the present embodiment. In particular, it is preferable that a plain knit structure be used in the area in which identical knit loops of the long cellulose fibers and hydrophobic fibers are formed. When a plain knit structure is used in the area in which identical knit loops of the long cellulose fibers and hydrophobic fibers are formed, the long cellulose fibers and the hydrophobic fibers can constitute the knit fabric in a more coherent state, and the hydrophobic fibers in the surface layer are further exposed to the atmosphere, whereby the quick-drying properties are improved. Though the structure used in the multilayer-structure circular knit fabric of the present embodiment is not particularly limited, the entirety of the knit fabric may be partially constituted by the plain knit structure in which identical loops of the long cellulose fibers and hydrophobic fibers are formed. For example, the knit fabric may be constituted by a structure in which identical loops of long cellulose fibers and hydrophobic fibers are formed, and a structure in which loops of only the hydrophobic fibers are formed. The phrase "loops of only the hydrophobic fibers are formed" means the formation of loops from the hydrophobic fibers singly or two or more fibers in combination. When two or more hydrophobic fibers are combined, the hydrophobic fibers may be of the same material or may be of different materials. As the specific structure, for example, a structure in which horizontal stripes are formed by first knitting 10 courses of plain knit structure in which identical knit loops of long cellulose fibers and hydrophobic fibers are formed, and thereafter knitting 10 courses of a moss knit structure of only hydrophobic fibers. Furthermore, a structure formed by first knitting one course of a plain knit structure in which identical loops of long cellulose fibers and hydrophobic fibers are formed, and thereafter knitting one course of a plain stitch of two strands of hydrophobic fibers may be used. Further, a structure in which the entirety of the knit fabric is constituted by a plain knit structure in which identical loops of the long cellulose fibers and the hydrophobic fibers are formed may be used. When the circular-knit fabric is composed of a structure in which identical loops of the long cellulose fibers and the hydrophobic fibers are formed, and a structure in which loops of only hydrophobic fibers are formed, the transfer of water from long cellulose fibers to hydrophobic fibers can be further promoted, whereby diffusivity can be increased, and quick-drying properties are improved.

The multilayer-structure circular knit fabric of the present embodiment preferably further comprises elastic fibers. By including elastic fibers, the sinker-loop side surface, which conventionally has a low anti-snag property, becomes dense, whereby deterioration of the fabric grade due to snagging on the sinker-loop side surface can be suppressed. Further, since elasticity is imparted to the knit fabric, the feeling of tension when worn is reduced, whereby ease of movement is promoted, and the sense of comfort is improved. Polyurethane elastic yarns, polyether/ester elastic yarns, polyamide elastic yarns, polyolefin elastic yarns, or alternatively, a covered yarn in which an inelastic fiber is covered with one of the yarns above may be used. Though a so-called "rubber yarn", which is a thread-like strand composed of a natural rubber, synthetic rubber, or semi-synthetic rubber, can be used, polyurethane elastic yarns, which are excellent in elasticity and conventionally widely adopted, are particularly preferable. The fineness of the elastic fiber is preferably 15 to 80 dtex, more preferably 20 to 60 dtex, and further preferably 20 to 50 dtex so that the garment does not become excessively heavy when worn.

Though the basis weight of the multilayer-structure circular knit fabric of the present embodiment may be appropriately set in accordance with the application, the basis weight is preferably 80 to 400 g/m$^2$, more preferably 100 to 350 g/m$^2$, further preferably 120 to 300 g/m$^2$, and particularly preferably 130 to 200 g/m$^2$. If the basis weight is less than 80 g/m$^2$, the filling rate of the circular-knit fabric becomes excessively low, whereby sufficient abrasion resistance and burst strength may not be obtained. Conversely, if the basis weight exceeds 400 g/m$^2$, the quick-drying properties are insufficient, whereby excellent refreshing properties may not be obtained.

Though the thickness of the multilayer-structure circular knit fabric of the present embodiment is not particularly limited, the thickness is preferably 0.4 to 1.3 mm, more preferably 0.5 to 1.2 mm, further preferably 0.6 to 1.0 mm, and particularly preferably 0.7 to 0.9 mm. Like the basis weight, if the thickness is less than 0.4 mm, sufficient abrasion resistance and burst strength may not be obtained, and if the thickness exceeds 1.3 mm, the quick-drying properties are insufficient, whereby excellent refreshing properties may not be obtained.

The gauge of the machine used to produce the multilayer-circular knit fabric of the present embodiment is not particularly limited. Though it is preferable that an 18 to 40-gauge machine be arbitrarily selected in accordance with the application and the thickness of the fibers used, in particular, 20 to 36-gauge is preferable in consideration of obtaining an appropriate basis weight as a garment, and versatility.

A garment including the multilayer-structure circular knit fabric of the present embodiment is intended to be used such that the needle-loop side surface of the circular-knit fabric, which is constituted by the long cellulose fibers, is the skin-contacting surface, and the sinker-loop side surface of the circular-knit fabric, which is constituted by the hydrophobic fibers, is the outer surface.

The multilayer-structure circular knit fabric of the present embodiment is produced by producing a greige knit fabric, and thereafter carrying out processes such as refining, thermal setting, and dyeing. The processing methods may be carried out in accordance with conventional circular-knit fabric processing methods. Furthermore, it is preferable that the finished density be appropriately adjusted in accordance with the required elongation properties, basis weight, thickness, tactile coolness, and quick-drying properties.

Further, during the dyeing stage, additional processing such as an antifouling treatment, antibacterial treatment, deodorization, odor-resistance treatment, sweat absorption processing, moisture absorption processing, UV absorption processing, weight loss processing, etc., and calendering, embossing, wrinkling, brushing, opal finishing, and softening treatment using a softening agent as post processing may be appropriately imparted in accordance with required properties such as ultimate tactile coolness and quick-drying properties.

EXAMPLES

The present invention will be specifically described by way of the Examples.

The evaluation methods of the Examples are as described below.

(i) Ratio of Long Cellulose Fibers (wt %)

A notch indicating 100 wales in the warp direction is formed on the knit fabric, the yarns constituting the knit structure are unraveled, and the types, thread counts thereof, and weights thereof are measured. The ratios of the thread weights are calculated with respect to the total thread weight.

(ii) Height Irregularity Difference

A cross-sectional photograph of the knit fabric is captured at an arbitrary magnification using a VHX-2000 digital microscope manufactured by Keyence Corporation. In measurement mode, the heights of the concave portions and the convex portions of the skin-contacting layer are measured using the surface layer as a reference, and the differences therebetween are calculated as the difference in height irregularity. Five arbitrary locations are measured.

(iii) Long Cellulose Fiber Exposure Rate

The knit fabric is subjected to reactive dyeing (1% of dark color reactive dye, bath ratio of sodium carbonate to sodium sulfate of 1:100, 60° C. for 30 minutes), color is imparted to the long cellulose fibers, and heat-setting is carried out until the density becomes equal to that prior to dyeing. A 3D image of the skin surface of the knit fabric is captured from the outermost layer of the skin surface of the knit fabric to the thickness of the knit fabric at a distance of 0.02 mm using a digital microscope KH-9700 manufactured by Hirox Corporation at a magnification of 100 times in 3D mode. Thereafter, in the area measurement mode, the image is color printed on a knit fabric cut horizontally at a position of 0.13 mm from the outermost layer of the skin surface as a reference. The printed image is conditioned for 24 hours in an environment of 20° C. and 65% RH, and the image portion is then cut out and horizontally cut (a portion deeper than 0.13 mm from the outermost layer of knit fabric skin surface). The dyed and colored fiber portion is cut off from the remainder of the printed image, the weight of the printed image is measured, and the ratio of the dyed and colored fiber part (long cellulose fiber) is calculated.

When the knit fabric is dyed, the long cellulose fibers are bleached and then re-set to the density prior to bleaching and measured.

(iv) Tactile Coolness

The maximum heat transfer rate (W/m$^2$/° C.) on the skin surface of a knit fabric, which has been cut to an 8 cm×8 cm square and conditioned at 20° C. and 65% RH, when placed on the hot plate of a KES-F7-II manufactured by KatoTech and heated to 10° C. above ambient temperature is measured.

(v) Quick-Drying Properties

The weight of a knit fabric, which has been cut to a 10 cm×10 cm square and conditioned at 20° C. and 65% RH, is measured, and thereafter, 0.3 cc of water is dripped onto the skin surface with a micropipette, and full absorption of the dripped water is confirmed. Next, starting from this time, weight is measured every 5 minutes in a suspended state, and measurement is continued until the moisture content of the knit fabric falls below 10%. The measured values are plotted on a graph to obtain the time at which the moisture content of the knit fabric became 10%.

(vi) Average Coefficient of Friction and Average Deviation of Coefficient of Friction The surface of a knit fabric in which the long cellulose fibers are arranged is wiped in the warp direction with a standard cotton cloth "canequim No. 3", which is a contactor, and thereafter, the coefficient of friction (MIU) and average deviation of the coefficient of friction (MMD) thereof are measured using a friction tester KES-SE-SP manufactured by KatoTech at a measurement speed of 1 mm/s under a load of 50 g. N=3 data is collected, the orientation of the warp direction is changed, an additional N=3 data is collected, and the average value thereof is calculated.

(vii) Fiber Length Ratio

A mark is made on a knit fabric in the range of 100 wales, and the long cellulose fibers and hydrophobic fibers are unraveled from the knit fabric. The upper ends of the unraveled fibers are secured, a load of 0.088 cN/dtex is attached to the lower ends thereof, and the length after 30 seconds has elapsed is measured (yarn length: mm/100 w). The fiber length ratio is calculated from these measurement values by the following formula:

fiber length ratio=(yarn length of long cellulose fibers)/(yarn length of hydrophobic fibers).

(viii) Single-Fiber Fineness Ratio of Long Cellulose Fibers to Hydrophobic Fibers The individual fibers are withdrawn from the knit fabric, the single-fiber finenesses thereof are determined, and single-fiber fineness ratio is calculated from the following formula:

single-fiber fineness ratio=(single-fiber fineness of hydrophobic fibers)/(single-fiber fineness of long cellulose fibers.

(ix) Fineness Ratio of Long Cellulose Fibers to Hydrophobic Fibers

The individual fibers are withdrawn from the knit fabric, the (total) fineness is determined, and the fineness ratio is calculated from the following formula:

fineness ratio=(fineness of hydrophobic fibers)/(fineness of long cellulose fibers).

(x) Hygroscopicity

A knit fabric cut to a 25 cm×25 cm square is dried for two hours at 110° C. using a dryer, and the weight of the sample when dry is measured. The sample is placed into a climate-controlled chamber at 20° C. and 90% RH, and the weight thereof is measured after 3 hours has elapsed. From the measured values, the rate of weight change under a 20° C. and 90% RH environment relative to the sample weight in the dry state is calculated.

(xi) Heat Dissipation

The heat retention of a knit fabric which has been conditioned at 20° C. and 65% RH is measured when placed on the hot plate of a KES-F7-II manufactured by KatoTech at 30° C. and an air volume of 0.3 m/s by a dry contact method, and the heat dissipation thereof is calculated from the following calculation formula:

heat dissipation amount ($W/m^2/°$ C.)=measurement value ($W/0.01\ m^2/10°$ C.)×(100/10).

(xii) Judgment of Texture

Ten monitors are given underwear T-shirts produced using trial knit fabrics to wear in an environment of 30° C. and 60% RH, and the texture focused primarily on tactile feeling (smoothness/rough feeling) when put on and taken off is evaluated based on the following five evaluations scores. The average value is taken as the evaluation result.

5: Smooth, Excellent Texture
4: Smooth, Good Texture
3: Cannot Say Either Way
2: Rough Feeling, Somewhat Poor Texture
1: Rough Feeling, Very Poor Texture (xiii) Judgement of Coolness Ten monitors are given underwear T-shirts produced using trial knit fabrics to wear in an environment of 30° C. and 60% RH, and the coolness by sensation is evaluated based on the following five evaluations scores. The average value is taken as the evaluation result.

5: Feels Very Cool
4: Feels Somewhat Cool
3: Cannot Say Either Way
2: Did Not Feel Significant Coolness
1: Did Not Feel Coolness at All

Example 1

A three-layer plain stitch knit fabric was produced using a 28 G single circular knitting machine by plating a No. 50 polyester spun yarn having a yarn length of 274 mm/100 w, a 22 dtex polyurethane elastic yarn having a yarn length of 98 mm/100 w, and 56 dtex/30 f cupra long fibers having a yarn length of 301 mm/100 w using the plain knit structure of FIG. 3, such that the fiber feed angle of the polyester spun yarn was greater than that of the cupra long fibers, wherein the polyester spun yarn was arranged in the sinker-loop side surface layer, the polyurethane elastic yarns were arranged in the knit fabric intermediate layer, and the cupra long fibers were arranged in the needle-loop side surface layer. Thereafter, conventional presetting was performed, and dye finishing was carried out. At that time, 2 wt % of the water absorption treatment agent SR-1000 manufactured by Takamatsu Yushi Co., Ltd., was added thereto, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was the on the skin-contacting surface, and the texture and coolness of the T-shirt were evaluated.

Example 2

A three-layer plain stitch knit fabric was produced using a 28 G single circular knitting machine by plating 84 dtex/72 f polyester long fibers having a yarn length of 264 mm/100 w, 44 dtex polyurethane elastic yarns having a yarn length of 94 mm/100 w, and 56 dtex/30 f cupra long fibers having a yarn length of 280 mm/100 w using the plain knit structure of FIG. 3, such that the fiber feed angle of the polyester long fibers was greater than that of the cupra long fibers, wherein the polyester long fibers were arranged in the sinker-loop side surface layer, the polyurethane elastic yarns were arranged in the knit fabric intermediate layer, and the cupra long fibers were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 3

A three-layer plain stitch knit fabric was produced using a 32 G single circular knitting machine by plating 45 dtex/36 f polyamide long fibers having a yarn length of 238 mm/100 w, 22 dtex polyurethane elastic yarns having a yarn length of 89 mm/100 w, and 33 dtex/24 f cupra long fibers having a yarn length of 250 mm/100 w using the plain knit structure of FIG. 3, such that the fiber feed angle of the polyamide long fibers was greater than that of the cupra long fibers, wherein the polyamide long fibers were arranged in the sinker-loop side surface layer, the polyurethane elastic yarns were arranged in the knit fabric intermediate layer, and the cupra long fibers were arranged in the needle-loop side surface layer. Thereafter, dye processing was performed in the same manner as Example 1, wherein a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 4

Using a 32 G single circular knitting machine, 45 dtex/36 f polyamide long fibers (i) having a yarn length of 238 mm/100 w, 22 dtex polyurethane elastic yarns having a yarn length of 89 mm/100 w, 33 dtex/34 f cupra long fibers having a yarn length of 250 mm/100 w, 45 dtex/36 f polyamide long fibers (ii) having a yarn length of 245 mm/100 w were plated using the plain knit structure of FIG. 3, wherein the polyamide long fibers (i), the polyurethane elastic yarns, and the cupra long fibers were plated, and thereafter the polyamide long fibers (i), the polyurethane elastic yarns, and the polyamide long fibers (ii) were plated to produce a skin surface layer having horizontal stripes of the cupra long fibers and the polyamide long fibers (ii). A three-layer plain stitch knit fabric was prepared by carrying out plating in which the fiber feed angle at that time was adjusted, in an area in which the cupra long fibers were arranged, such that the fiber feed angle of the polyamide long fibers (i) was greater than that of the cupra long fibers, and in an area in which the polyamide long fibers (ii) were arranged, such that the fiber feed angle of the polyamide long fibers (i) was greater than that of the polyamide long fibers (ii), wherein the polyamide long fibers (i) were arranged in the sinker-loop side surface layer, the polyurethane elastic yarns were arranged in the knit fabric intermediate layer, and the cupra long fibers and the polyamide long fibers (ii) were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 5

A three-layer plain stitch knit fabric was produced using a 36 G single circular knitting machine by plating 78 dtex/72 f polyamide long fibers having a yarn length of 210 mm/100 w, 22 dtex polyurethane elastic yarns having a yarn length of 75 mm/100 w, and 56 dtex/30 f cupra long fibers having a yarn length of 215 mm/100 w using the plain knit structure of FIG. 3, such that the fiber feed angle of the polyamide long fibers was greater than that of the cupra long fibers, wherein the polyamide long fibers were arranged in the sinker-loop side surface layer, the polyurethane elastic yarns were arranged in the knit fabric intermediate layer, and the cupra long fibers were arranged in the needle-loop side surface layer. Thereafter, dye processing was performed in the same manner as Example 1, whereby a multilayer circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 6

A multilayer circular knit fabric having the properties and functions shown in Table 1 below was produced using the same yarn type, knitting method, and dyeing process as Example 1, except that during finish dyeing, a water absorption treatment was not applied. Subsequently, a T-shirt was sewn using the obtained knit fabric such that the needle-loop side was on the skin-contacting surface, and the texture and coolness of the T-shirt were evaluated.

Example 7

A three-layer plain stitch knit fabric was produced using a 28 G single circular knitting machine by plating 84 dtex/36 f polyester long fibers having a yarn length of 264 mm/100 w, 44 dtex polyurethane elastic yarns having a yarn length of 94 mm/100 w, and 56 dtex/30 f cupra long fibers having a yarn length of 280 mm/100 w using the plain knit structure of FIG. 3 such that the fiber feed angle of the polyester long fibers was greater than that of the of the cupra long fibers, wherein the polyester long fibers were arranged in the sinker-loop side surface layer, the polyurethane elastic yarns were arranged in the knit fabric intermediate layer, and the cupra long fibers were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 8

A three-layer plain stitch knit fabric was produced using a 28 G single circular knitting machine by plating 44 dtex/36 f polyester long fibers having a yarn length of 255 mm/100 w, 44 dtex polyurethane elastic yarns having a yarn length of 88 mm/100 w, and 56 dtex/30 f cupra long fibers having a yarn length of 263 mm/100 w using the plain knit structure of FIG. 3 such that the fiber feed angle of the polyester long fibers was greater than that of the cupra long fibers, wherein the polyester long fibers were arranged in the sinker-loop side surface layer, the polyurethane elastic yarns were arranged in the knit fabric intermediate layer, and the cupra long fibers were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 9

A three-layer plain stitch knit fabric was produced using a 24 G circular knitting machine by plating 167 dtex/144 f polyester long fibers having a yarn length of 316 mm/100 w, 78 dtex polyurethane elastic yarns having a yarn length of 103 mm/100 w, and 84 dtex/45 f cupra long fibers having a yarn length of 328 mm/100 w using the plain knit structure of FIG. 3 such that the fiber feed angle of the polyester long fibers was greater than that of the cupra long fibers, wherein the polyester long fibers were arranged in the sinker-loop side surface layer, the polyurethane elastic yarns were arranged in the knit fabric intermediate layer, and the cupra long fibers were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 10

A two-layer plain stitch knit fabric was produced using a 28 G single circular knitting machine by plating 84 dtex/72 f polyester long fibers having a yarn length of 240 mm/100 w, and 56 dtex/30 f cupra long fibers having a yarn length of 225 mm/100 w using the plain knit structure of FIG. 3 such that the fiber feed angle of the polyester long fibers was greater than that of the cupra long fibers, wherein the polyester long fibers were arranged in the sinker-loop side surface layer and the cupra long fibers were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Example 11

A three-layer plain stitch knit fabric was produced using a 24 G circular knitting machine by plating 84 dtex/72 f polyester long fibers having a yarn length of 310 mm/100 w, 22 dtex polyurethane elastic yarns having a yarn length of 124 mm/100 w, and a 112 dtex/102 f mixed yarn having a yarn length of 335 mm/100 w, in which 56 dtex/30 f cupra long fibers and 56 dtex/72 f polyester long fibers were mixed, using the plain knit structure of FIG. 3 such that the fiber feed angle of the polyester long fibers was greater than that of the mixed yarn, wherein the polyester long fibers were arranged in the sinker-loop side surface layer and the mixed yarn was arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 1

A three-layer plain stitch knit fabric was produced using a 24 G single circular knitting machine by plating a No. 50 polyester spun yarn having a yarn length of 282 mm/100 w, 22 dtex polyurethane elastic yarns having a yarn length of 98 mm/100 w, and 56 dtex/30 f cupra long fibers having a yarn length of 274 mm/100 w using the plain knit structure of FIG. 3 such that the fiber feed angle of the cupra long fibers was greater than that of the polyester spun yarn, wherein the polyester spun yarn was arranged in the needle-loop side surface layer, the polyurethane elastic yarns were arranged in the knit fabric intermediate layer, and the cupra long fibers were arranged in the sinker-loop side surface layer. Thereafter, conventional presetting was performed, and dye finishing was carried out. At that time, 2 wt % of the water absorption treatment agent SR-1000 manufactured by Takamatsu Yushi Co., Ltd., was added thereto, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was the on the skin-contacting surface, and the texture and coolness of the T-shirt were evaluated.

Comparative Example 2

Figure 4:
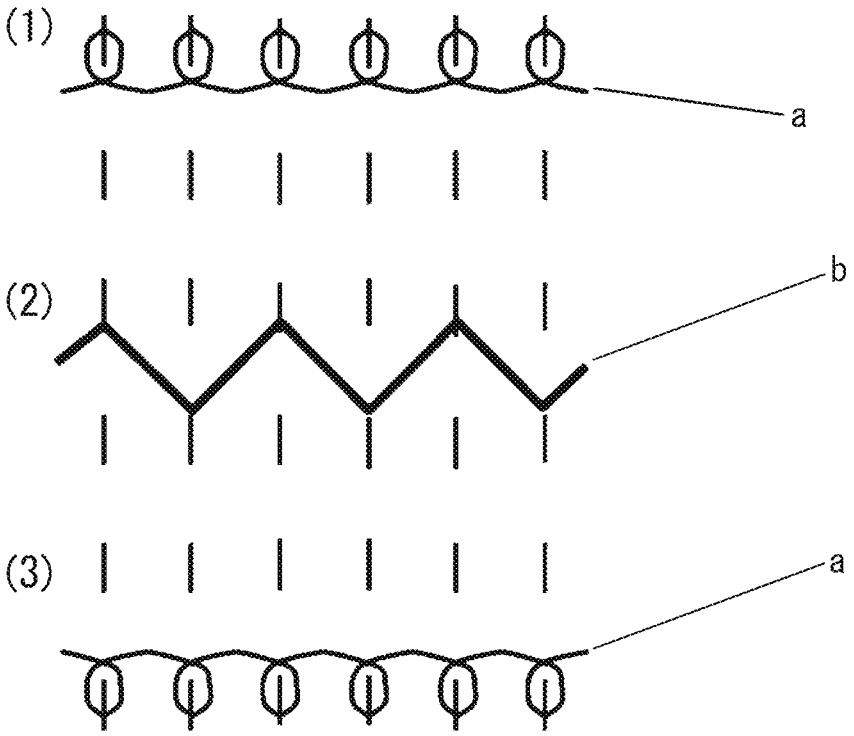
Prior Art FIG. 4
FIG. 4 is an example of the knitting structure of a conventional knit fabric.

A three-layer knit fabric was produced using a 28 G double circular knitting machine, in which the surface layer and skin surface layer were constituted by 84 dtex/24 f polyester long fibers, and 56 dtex/30 f cupra long fibers serving as a connection thread for connecting the surface layer and the skin surface layer were arranged in the intermediate layer of the knit fabric using the double-sided tack knit structure shown in FIG. 4. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 3

A three-layer plain stitch knit fabric was produced using a 28 G single circular knitting machine by plating 56 dtex/48 f polyester long fibers having a yarn length of 225 mm/100 w, and 84 dtex/45 f cupra long fibers having a yarn length of 240 mm/100 w using the plain knit structure of FIG. 3 such that the fiber feed angle of the cupra long fibers was greater than that of the cotton, wherein the cotton was arranged in the sinker-loop side surface layer and the cupra long fibers were arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 4

A two-layer bare plain stitch was produced using a 32 G single circular knitting machine by plating 84 dtex/72 f polyester long fibers having a yarn length of 252 mm/100 w, and 22 dtex polyurethane elastic yarns having a yarn length of 90 mm/100 w. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 5

A three-layer plain stitch knit fabric was produced using a 24 G single circular knitting machine by plating a No. 50 polyester spun yarn having a yarn length of 275 mm/100 w, 22 dtex polyurethane elastic yarns having a yarn length of 91 mm/100 w, and a No. 80 modal spun yarn having a yarn length of 284 mm/100 w using the plain knit structure of FIG. 3 such that the fiber feed angle of the polyester spun yarn was greater than that of the cupra long fibers, wherein the polyester spun yarn was arranged in the sinker-loop side surface layer, the polyurethane elastic yarn were arranged in the knit fabric intermediate layer, and the modal spun yarn was arranged in the needle-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 6

Using a 28 G single circular knitting machine, 84 dtex/27 f polyester long fibers (i) having a yarn length of 285 mm/100 w, 44 dtex polyurethane elastic yarns having a yarn length of 94 mm/100 w, 56 dtex/30 f cupra long fibers having a yarn length of 280 mm/100 w, and 84 dtex/72 f polyester long fibers (ii) having a yarn length of 280 mm/100 w were plated using the plain knit structure of FIG. 3, wherein the polyester long fibers (i), the polyurethane elastic yarns, and the cupra long fibers were plated, and thereafter the polyester long fibers (i), the polyurethane elastic yarns, and the polyester long fibers (ii) were plated to produce a skin surface layer having horizontal stripes of the cupra long fibers and the polyester long fibers (ii). A three-layer plain stitch knit fabric was prepared by carrying out plating in which the fiber feed angle at that time was adjusted, in an area in which the cupra long fibers were arranged, such that the fiber feed angle of the polyester long fibers (i) was less than that of the cupra long fibers, and in an area in which the polyester long fibers (ii) were arranged, such that the fiber feed angle of the polyester long fibers (i) was less than that of the polyester long fibers (ii), wherein the polyester long fibers (i) were arranged in the sinker-loop side surface layer, the polyurethane elastic yarns were arranged in the knit fabric intermediate layer, and the cupra long fibers and the polyester long fibers (ii) were arranged in the needle-loop side surface layer. In this knit fabric, since the yarn length of the cupra long fibers was greater than that of the polyester long fibers, and the fiber feed angle of the cupra long fibers was adjusted so as to be less than that of the polyester long fibers, the polyester long fibers and the cupra long fibers were arranged in both the needle-loop side surface layer and the sinker-loop side surface layer. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 7

A two-layer bare plain stitch was produced using a 32 G single circular knitting machine by plating 84 dtex/45 f cupra long fibers having a yarn length of 252 mm/100 w and 22 dtex polyurethane elastic yarns having a yarn length of 90 mm/100 w using the plain knit structure of FIG. 3. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

Comparative Example 8

A three-layer knit fabric was produced using a 28 G double circular knitting machine in which the surface layer was constituted by 84 dtex/24 f polyester long fibers, the skin surface layer was constituted by 84 dtex/45 f cupra long fibers, and 56 dtex/36 f polyester long fibers serving as a connection thread for connecting the surface layer and the skin surface layer were arranged in the intermediate layer of the knit fabric using the double-sided tack knit structure shown in FIG. 4. Thereafter, dye processing was performed in the same manner as Example 1, whereby a multilayer-structure circular knit fabric having the properties and functions shown in Table 1 below and in which the skin surface was the needle-loop side surface was obtained. Subsequently, a T-shirt was sewn using the obtained knit fabric such that the needle-loop side was on the skin-contacting surface, and the texture and coolness of the T-shirt were evaluated.

TABLE 1

| | | Ex 1 | Ex 2 | Ex 3 | Ex 4 | Ex 5 | Ex 6 |
|---|---|---|---|---|---|---|---|
| Knitting Machine | | Single | ← | ← | ← | ← | ← |
| Gauge | | 28GG | ← | 32GG | ← | 36GG | 28GG |
| Knitting Structure | | Plain | ← | ← | ← | ← | ← |
| Knitting/Method | | Plating | ← | ← | ← | ← | ← |
| Layer Structure | | 3-Layer | ← | ← | ← | ← | ← |
| Needle-Loop Side Stuface Layer | Type | Cupra | ← | ← | ← Polyamide | Cupra | ← |
| | Yarn Type | 56 dtex/30 f | ← | 33 dtex/24 f | ← 45 dtex/36 f | 56 dtex/30 f | ← |
| | Single-Fiber Fineness dtex | 1.87 | ← | 1.38 | ← 1.25 | 1.87 | ← |
| | Yarn Length mm/100 w | 301 | 280 | 250 | ← 245 | 215 | 282 |
| | Fiber Feed Angle | 22 | ← | ← | ← ← | 23 | ← |
| | Mixing Rate wt % | 35 | 37 | 39 | 26 35 | 40 | 35 |
| Knit Fabric Intermediate Layer | Type | Polyurethane | ← | ← | ← | ← | ← |
| | Yarn Type | 22 dtex | 44 dtex | 22 dtex | ← | ← | ← |
| | Single-Fiber Fineness dtex | — | ← | ← | ← | ← | ← |
| | Yarn Length nun/100w | 98 | 94 | 89 | ← | 75 | 98 |
| | Fiber Feed Angle | 35 | ← | ← | ← | ← | ← |
| | Mixing Rate weight % | 5 | 10 | 9 | 6 | 5 | 5 |
| Sinker-Loop Side Stuface Layer | Type | Polyester | ← | Polyamide | ← | ← | Polyester |
| | Yarn Type | No. 50 | 84 dtex/72 f | 45 dtex/36 f | ← | 78 dtex/72 f | No. 50 |
| | Single-Fiber Fineness dtex | 1.20 | 1.17 | 1.25 | ← | 1.08 | 1.20 |
| | Yarn Length mm/100 w | 274 | 264 | 238 | ← | 210 | 274 |
| | Fiber Feed Angle | 40 | ← | ← | ← | 45 | 40 |
| | Mixing Rate wt % | 60 | 53 | 52 | 34 | 55 | 60 |

TABLE 1-continued

| | | | | | | | |
|---|---|---|---|---|---|---|---|
| Skin Contact Surface | | Needle-Loop Side | ← | ← | ← | ← | ← |
| Presence/Absence of Water Absorption Treatment | | Present | ← | ← | ← | ← | Absent |
| Yam Length Ratio | | 1.10 | 1.06 | 1.05 | ← | ← | 1.02 | 1.03 |
| Single- Fiber Fineness Ratio | | 0.64 | 0.62 | 0.91 | 0.91 | 1.00 | 0.58 | 0.64 |
| Fineness Ratio | | 2.10 | 1.50 | 1.36 | ← | 1.00 | 1.39 | 2.11 |
| Basis Weight | $g/m^2$ | 160 | 200 | 140 | 145 | 170 | 185 |
| Thickness | mm | 0.62 | 0.71 | 0.59 | 0.6 | 0.73 | 0.66 |
| Height Irregularity | mm | 0.083 | 0.092 | 0.075 | 0.086 | 0.091 | 0.083 |
| Ratio of Cellulose Long Fibers on Skin Surface % | | 91 | 93 | 90 | 39 | 92 | 91 |
| Qmax | $W/m^2/°$ C. | 160 | 152 | 162 | 156 | 159 | 160 |
| Quick-Drying | minutes | 40 | 35 | 39 | 31 | 46 | 48 |
| Average Coefficient of Friction | MIU | 0.35 | 0.40 | 0.36 | 0.43 | 0.39 | 0.35 |
| Average Deviation of Coefficient of Friction | MDD | 0.0081 | 0.0086 | 0.0075 | 0.0088 | 0.0079 | 0.0081 |
| Moisture Absorption Rate | % | 4.6 | 6.1 | 9.9 | 7.6 | 9.7 | 4.6 |
| Heat Dissipation | $W/m^2/°$ C. | 9.1 | 9.4 | 10.4 | 10.7 | 9.2 | 9.1 |
| Texture | | 5 | 5 | 5 | 4 | 5 | 5 |
| Coolness | | 4 | 4 | 5 | 5 | 5 | 4 |

| | | Ex 7 | Ex 8 | Ex 9 | Ex 10 | Ex 11 |
|---|---|---|---|---|---|---|
| Knitting Machine | | ← | ← | ← | ← | ← |
| Gauge | | ← | ← | 24GG | 28GG | 24GG |
| Knitting Structure | | ← | ← | ← | ← | ← |
| Knitting/Method | | ← | ← | ← | ← | ← |
| Layer Structure | | 3-Layer | ← | ← | 2-Layer | 3-Layer |
| Needle-Loop Side Stuface Layer | Type | Cupra | ← | ← | ← | ← Polyester |
| | Yarn Type | 56 dtex/30 f | ← | 84 dtex/45 f | 56 dtex/30 f | ← 56 dtex/72 f |
| | Single-Fiber Fineness dtex | 1.87 | ← | ← | ← | ← 0.78 |
| | Yarn Length mm/100 w | 280 | 263 | 328 | 240 | 335 |
| | Fiber Feed Angle | 22 | ← | ← | ← | ← |
| | Mixing Rate wt % | 37 | 49 | 31 | 42 | 28 28 |
| Knit Fabric Intermediate Layer | Type | Polyurethane | ← | Polyurethane | — | Polyurethane |
| | Yarn Type | 44 dtex | ← | 78 dtex | — | 22 dtex |
| | Single-Fiber Fineness dtex | ← | ← | ← | — | — |
| | Yarn Length nun/100w | 94 | 88 | 103 | — | 124 |
| | Fiber Feed Angle | 35 | ← | ← | — | 35 |
| | Mixing Rate weight % | 10 | 13 | 9 | — | 4 |
| Sinker-Loop Side Stuface Layer | Type | ← | ← | ← | ← | ← |
| | Yarn Type | 84 dtex/36 f | 44 dtex/36 f | 167 dtex/144 f | 84 dtex/72 f | 84 dtex/72 f |
| | Single-Fiber Fineness dtex | 2.33 | 1.22 | 1.16 | 1.17 | ← |
| | Yarn Length mm/100 w | 264 | 255 | 316 | 225 | 310 |
| | Fiber Feed Angle | ← | ← | ← | ← | ← |
| | Mixing Rate wt % | 53 | 38 | 60 | 58 | 40 |
| Skin Contact Surface | | ← | ← | ← | ← | ← |
| Presence/Absence of Water Absorption Treatment | | Present | ← | ← | ← | ← |
| Yam Length Ratio | | 1.06 | 1.03 | 1.04 | 1.07 | 1.08 |
| Single- Fiber Fineness Ratio | | 1.25 | 0.65 | 0.62 | 0.63 | 0.63 1.50 |
| Fineness Ratio | | 1.50 | 0.79 | 1.99 | 1.50 | 1.50 1.50 |
| Basis Weight | $g/m^2$ | 200 | 185 | 320 | 160 | 260 |
| Thickness | mm | 0.73 | 0.65 | 0.92 | 0.60 | 0.77 |
| Height Irregularity | mm | 0.091 | 0.088 | 0.134 | 0.096 | 0.112 |
| Ratio of Cellulose Long Fibers on Skin Surface % | | 93 | 81 | 95 | 91 | 45 |
| Qmax | $W/m^2/°$ C. | 151 | 137 | 130 | 148 | 133 |
| Quick-Drying | minutes | 45 | 48 | 45 | 38 | 32 |
| Average Coefficient of Friction | MIU | 0.41 | 0.42 | 0.46 | 0.41 | 0.47 |
| Average Deviation of Coefficient of Friction | MDD | 0.0088 | 0.0088 | 0.0094 | 0.0082 | 0.0094 |
| Moisture Absorption Rate | % | 6.1 | 8.4 | 5.9 | 6.7 | 5.7 |
| Heat Dissipation | $W/m^2/°$ C. | 9.2 | 9.5 | 9.2 | 9.4 | 9.1 |
| Texture | | 5 | 4 | 4 | 4 | 4 |
| Coolness | | 4 | 4 | 5 | 4 | 4 |

TABLE 2

| | | Comp Ex 1 | Comp Ex 2 | Comp Ex 3 | Comp Ex 4 | Comp Ex 5 | Comp Ex 6 | | Comp Ex 7 | Comp Ex 8 |
|---|---|---|---|---|---|---|---|---|---|---|
| Knitting Machine | | Single | Double | Single | ← | ← | ← | | ← | Double |
| Gauge | | 24G | 28G | ← | 32GG | 24G | 28GG | | 32GG | 28G |
| Knitting Structure | | Plain | Double-sided Tack Knit | Plain | ← | ← | ← | | ← | Double-sided Tack Knit |
| Knitting Method | | Plating | Various Individual Types | Plating | Plating | ← | ← | | Plating | Various Individual Types |
| Layer Structure | | 3-Layer | ← | 2-Layer | ← | 3-Layer | ← | | 2-Layer | 3-Layer |
| Needle-Loop Side Surface Layer | Type | Polyester | Polyester | Cupra | Polyester | Modal | Cupra | Polyester | Cupra | Polyester |
| | Yarn Tyke | No. 50 | 84 dtex/24 f | 84 dtex/45 f | 84 dtex/72 f | No. 80 | 56 dtex/30 f | 84 dtex/72 f | 84 dtex/45 f | 84 dtex/24 f |
| | Single-Fiber Fineness dtex | 1.20 | 3.50 | 1.87 | 1.17 | 1.10 | 1.87 | 1.17 | 1.87 | 3.50 |
| | Yarn Length mm/100 w | 282 | 230 | 240 | 252 | 284 | 280 | ← | 252 | 230 |
| | Fiber Feed Angle | 22 | 45 | 22 | ← | ← | 45 | 45 | 22 | 45 |
| | Mixing Rate wt % | 63 | 33 | 62 | 91 | 37 | 16 | 25 | 91 | 33 |
| Knit Fabric Intermediate Layer | Type | Polyurethane | Cupra | — | Polyurethane | Polyurethane | ← | | Polyurethane | Polyester |
| | Yarn Tyke | 22 dtex | 56 dtex/30 f | — | 22 dtex | 22 dtex | 44 dtex | | 22 dtex | 56 dtex/36 f |
| | Single-Fiber Fineness dtex | — | 1.87 | — | — | ← | ← | | — | 1.56 |
| | Yarn Length mm/100 w | 98 | 500 | — | 90 | 91 | 94 | | 90 | 500 |
| | Fiber Feed Angle | 35 | 45 | — | 35 | 35 | ← | | 35 | 45 |
| | Mixing Rate wt % | 5 | 34 | — | 9 | 4 | 9 | | 9 | 34 |
| Sinker-Loop Side Surface Layer | Type | Cupa | Polyester | Polyester | — | Polyester | ← | | — | Cupra |
| | Yarn Tyke | 56 dtex/30 f | 84 dtex/24 f | 56 dtex/48 f | — | No. 50 | 84 dtex/72 f | | — | 84 dtex/45 f |
| | Single-Fiber Fineness dtex | 1.87 | 3.50 | 1.17 | — | 1.20 | 1.17 | | — | 1.87 |
| | Yarn Length mm/100 w | 274 | 215 | 225 | — | 275 | 285 | | — | 215 |
| | Fiber Feed Angle | 40 | 45 | 40 | — | 40 | 23 | | — | 45 |
| | Mixing Rate wt % | 32 | 33 | 38 | — | 59 | 50 | | — | 33 |
| Skin Contact Surface | | Sinker-Loop Side | Needle-Loop Side | ← | ← | ← | ← | | ← | ← |
| Presence/Absence of Water Absorption Treatment | | Present | ← | ← | ← | ← | ← | | ← | ← |
| Yarn Length Ratio | | 1.03 | 1.07 | 1.07 | — | 1.03 | 0.98 | ← | ← | 0.93 |
| Single-Fiber Fineness Ratio | | 0.64 | 1.87 | 0.63 | — | 1.09 | 0.62 | 1.00 | ← | 0.53 |
| Fineness Ratio | | 2.10 | 1.50 | 0.67 | — | 1.60 | 1.50 | ← | ← | 1.00 |
| Basis Weight | $g/m^2$ | 185 | 187 | 155 | 140 | 190 | 200 | | ← | 190 |
| Thickness | mm | 0.66 | 1.33 | 0.63 | 0.47 | 0.73 | 0.71 | | 0.45 | 1.34 |
| Height Irregularity | mm | 0.41 | 0.11 | 0.101 | 0.082 | 0.0078 | 0.105 | | 0.086 | 0.11 |
| Ratio of Cellulose Long Fibers on Skin Surface % | | 93 | 0 | 90 | 0 | 0 | 21 | | 100 | 98 |
| Qmax | $W/m^2/°$ C. | 118 | 97 | 158 | 93 | 128 | 122 | | 165 | 159 |
| Quick-Drying | min | 41 | 32 | 71 | 25 | 57 | 35 | | 74 | 77 |
| Average Coefficient of Friction | MIU | 0.79 | 0.40 | 0.42 | 0.44 | 0.39 | 0.53 | | 0.35 | 0.38 |
| Average Deviation of Coefficient of Friction | MDD | 0.0126 | 0.0095 | 0.0084 | 0.0083 | 0.0093 | 0.0088 | | 0.0079 | 0.0092 |
| Moisture Absorption Rate | % | 4.6 | 5.6 | 7.9 | 0.5 | 4.7 | 4.2 | | 12.7 | 5.0 |
| Heat Dissipation | $W/m^2/°$ C. | 9 | 8.1 | 9.5 | 10 | 8.6 | 9.1 | | 10.1 | 8.3 |
| Texture | | 1 | 3 | 4 | 3 | 3 | 4 | | 5 | 5 |
| Coolness | | 4 | 2 | 3 | 2 | 3 | 3 | | 3 | 2 |

As shown in Tables 1 and 2, in all of the Comparative Examples, simultaneous satisfaction of hygroscopicity, tactile coolness, water-absorption quick-drying, and excellent texture could not be obtained. In Comparative Example 3 in particular, though excellent evaluation results regarding texture and coolness were obtained, the garment had inferior water-absorption quick-drying and insufficient sweat processing performance. In the Examples, all of these properties were satisfied, and garments having excellent texture, refreshing properties, and sweat processing performance were obtained.

INDUSTRIAL APPLICABILITY

The garment according to the present invention has excellent tactile coolness and hygroscopicity, improved water diffusion properties, does not feel stuffy due to the presence of quick-drying properties, has a high refreshing sensation, and dries sweat quickly, whereby the feeling of stickiness and post-sweat chill can be limited. Since the garment according to the present invention includes a multilayer-structure circular knit fabric having suitable texture, the garment is suitable as an undergarment, sportwear, or casualwear.

REFERENCE SIGNS LIST a long cellulose fibers
b hydrophobic fibers
c elastic fibers
A fiber feed angle of fibers used in needle-loop side surface layer
B fiber feed angle of fibers used in sinker-loop side surface layer

The invention claimed is:

1. A garment comprising a multilayer-structure circular knit fabric composed of a single circular knit having a layer structure of at least two layers, and having a skin-contacting surface which is a needle-loop side of the circular-knit fabric, wherein the circular-knit fabric has a portion in which long cellulose fibers and hydrophobic fibers are knitted together to form identical knit loops, the circular-knit fabric contains 10 to 50 wt % of the long cellulose fibers, an exposure rate of the long cellulose fibers in a region from the skin-contacting surface within 0.13 mm toward an interior of the circular-knit fabric is at least 30%, a tactile coolness of the circular-knit fabric is 130 to 200 $W/m^{2}\cdot{}^{\circ}C.$, and the time at which a moisture content of the circular-knit fabric becomes 10% after 0.3 cc of water is dripped thereon is not greater than 50 minutes, and a difference in height irregularities of the skin-contacting surface of the multilayer-structure circular knit fabric is not greater than 0.10 mm.

2. The garment according to claim 1, wherein a single-fiber fineness of the long cellulose fibers is 0.1 to 7.0 dtex.

3. The garment according to claim 1, wherein an average coefficient of friction of the skin-contacting surface of the circular-knit fabric is not greater than 0.45, and an average deviation of the average coefficient of friction is not greater than 0.0090.

4. The garment according to claim 1, wherein the multilayer-structure circular knit fabric has a plain knit structure.

5. The garment according to claim 1, wherein a fiber length ratio of the long cellulose fibers to the hydrophobic fibers is 1.01 to 1.20.

6. The garment according to claim 1, wherein a single-fiber fineness ratio of the long cellulose fibers to the hydrophobic fibers is 0.3 to 1.0.

7. The garment according to claim 1, wherein a total fineness ratio of the long cellulose fibers to the hydrophobic fibers is 1.0 to 3.0.

8. The garment according to claim 1, wherein the multilayer-structure circular knit fabric has undergone a water absorption treatment.

9. The garment according to claim 1, wherein the multilayer-structure circular knit fabric further includes elastic fibers, and the elastic fibers are arranged in an intermediate layer.

10. The garment according to claim 1, wherein the multilayer-structure circular knit fabric is composed of a structure in which identical loops of the long cellulose fibers and the hydrophobic fibers are formed, and a structure in which only loops of the hydrophobic fibers are formed.

* * * * *